US005357833A

United States Patent [19]

Biagiotti

[11] Patent Number: 5,357,833

[45] Date of Patent: Oct. 25, 1994

[54] DEVICE (CLAMP) FOR RETAINING ROLLS OR LOGS BY PRESSURE IN CUTTERS FOR THE PRODUCTION OF TOILET PAPER AND OTHER ITEMS

[75] Inventor: Guglilemo Biagiotti, Capannori, Italy

[73] Assignee: Fabio Perini S.p.A., Lucca, Italy

[21] Appl. No.: 150,540

[22] Filed: Nov. 10, 1993

Related U.S. Application Data

[63] Continuation of Ser. No. 915,945, Jul. 17, 1992, abandoned.

[30] Foreign Application Priority Data

Jul. 31, 1991 [IT] Italy ..... FI/91/A192
Jun. 10, 1992 [EP] European Pat. Off. ..... 92830304.9

[51] Int. Cl.[5] ..... B26D 3/16; B26D 7/02

[52] U.S. Cl. ..... 83/458; 83/465; 269/130

[58] Field of Search ..... 83/465, 666, 458, 924; 269/130, 131, 132, 254 R, 287, 153, 43

[56] References Cited

U.S. PATENT DOCUMENTS

| | | | |
|---|---|---|---|
| 2,025,086 | 12/1935 | Black | 269/131 |
| 3,049,954 | 8/1962 | Barlament et al. | 83/465 |
| 3,285,490 | 11/1966 | Roper | 269/130 |
| 4,872,655 | 10/1989 | Seele | 269/130 |
| 5,000,465 | 3/1991 | Seele | 269/130 |
| 5,038,647 | 8/1991 | Biagiotti | 83/458 |

*Primary Examiner*—Hien H. Phan
*Attorney, Agent, or Firm*—Francis J. Bouda

[57] ABSTRACT

The pressure-retaining device or clamp acts on the roll or log adjacently to the cutting plane and may be adapted to various diameters of the material being processed; for each path of advance of the rolls or logs (B) and on each side of the cutting plane, it comprises: a pair of symmetrically curved flexible strips (12, 14) projecting from enclosing supports (9A, 10; 7A, 10) and having end portions able to move according to the variation in the diameter of the roll, and a strap (22) fixed to elastic return holders (24A) and adjusting holders, said strap surrounding the pair of strips (12, 14) so as to vary their geometry in relation to the variation in the diameter of the material being processed.

14 Claims, 7 Drawing Sheets

DEVICE (CLAMP) FOR RETAINING ROLLS OR LOGS BY PRESSURE IN CUTTERS FOR THE PRODUCTION OF TOILET PAPER AND OTHER ITEMS

This application is a continuation of U.S. patent application Ser. No. 07/915,945 filed Jul. 17, 1992 (now abandoned).

The invention relates to a device for retaining material by pressure adjacently to the cutting plane, for cutters of rolls or logs of rolled paper, for forming small rolls of toilet paper or kitchen rolls (general-purpose towels) and other items. The device must be able to be adapted to various diameters of the material being processed. One object of the invention is to provide a clamp which is rapidly adjustable. A further object is to obtain economical adjustment without the replacement of components. These and other objects and advantages will be clearly understood from a reading of the text below.

The clamp device according to the invention substantially comprises, for each path of advance of the rolls or logs and on each side of the cutting plane:

- a pair of symmetrically curved elastically flexible strips, projecting from enclosing supports, and having end portions able to move according to the variation in the diameters and having an elastic tendency to expand; and
- a strap fixed to elastic return and adjusting holders, and surrounding the pair of strips so as to vary their geometry in relation to the variation in the diameter of the material being processed. In the context of the present invention the term "strap" is to be understood in a broad sense. It may consist, in particular, of piano-wire tape or other material suitable for this purpose.

In practice, the movable ends of the strips may be overlapped and slide over each other. The strap may act in combination with the strips to form the sliding path of the log in movement, and surrounds said path over approximately half a circumference; two opposing oscillating cradles, which adapt to the strips in the various geometries which they may assume, are provided adjacent to the enclosing supports. At least one of the two oscillating cradles, which is subject to the force of the disk-shaped blade, may be locked in the angular position assumed as a result of the adjustment according to the diameter of the material being processed.

The strap may be held by an elastically prestressed holder. An adjustment system—of the jack or other type—is provided for the adjustment of the geometry of the straps according to the diameter of the material being processed.

A single jack may act on the two adjacent straps of a cutter with two tracks for advancing and cutting adjacent rolls. A single jack may also act on the straps of one or two pairs of strips acting on the material on both sides of the cutting plane.

Stops acting on the strips to prevent dragging the strips due to friction with the advancing material may advantageously be provided. Said stops may be formed by the edges of the strap, with the inner strip supported on the outer strip, or be external components which are adjustable according to the geometry assumed at different times by the strips.

To lock two oscillating cradles, these may have an extension which continues as far as a corresponding joint engaging with a plate which is movable in a plane orthogonal to the axes of oscillation of the cradles and may be locked with a brake shoe in the geometry assumed on each occasion after adjustment.

In a possible embodiment, the possibility of locking both oscillating cradles may be provided. For this purpose, they may both be coupled to extensions which interact with means of adjusting and locking, for example with threaded rod means.

The clamp described here may advantageously be applied to cutting machines such as those described in Italian Patent Application No. FI91A 000071 and to all machines in which an opening and closing movement of the clamps for each cutting operation is not required.

Further advantageous characteristics of the invention are indicated in the attached claims.

The invention will be more clearly understood by following the description and the attached drawing which shows a non-restrictive practical example of the invention. In the drawing, FIGS. 1 and 2 show an axial view and a side view of a set of clamps acting on two adjacent rolls or logs being advanced;

Figure 1:
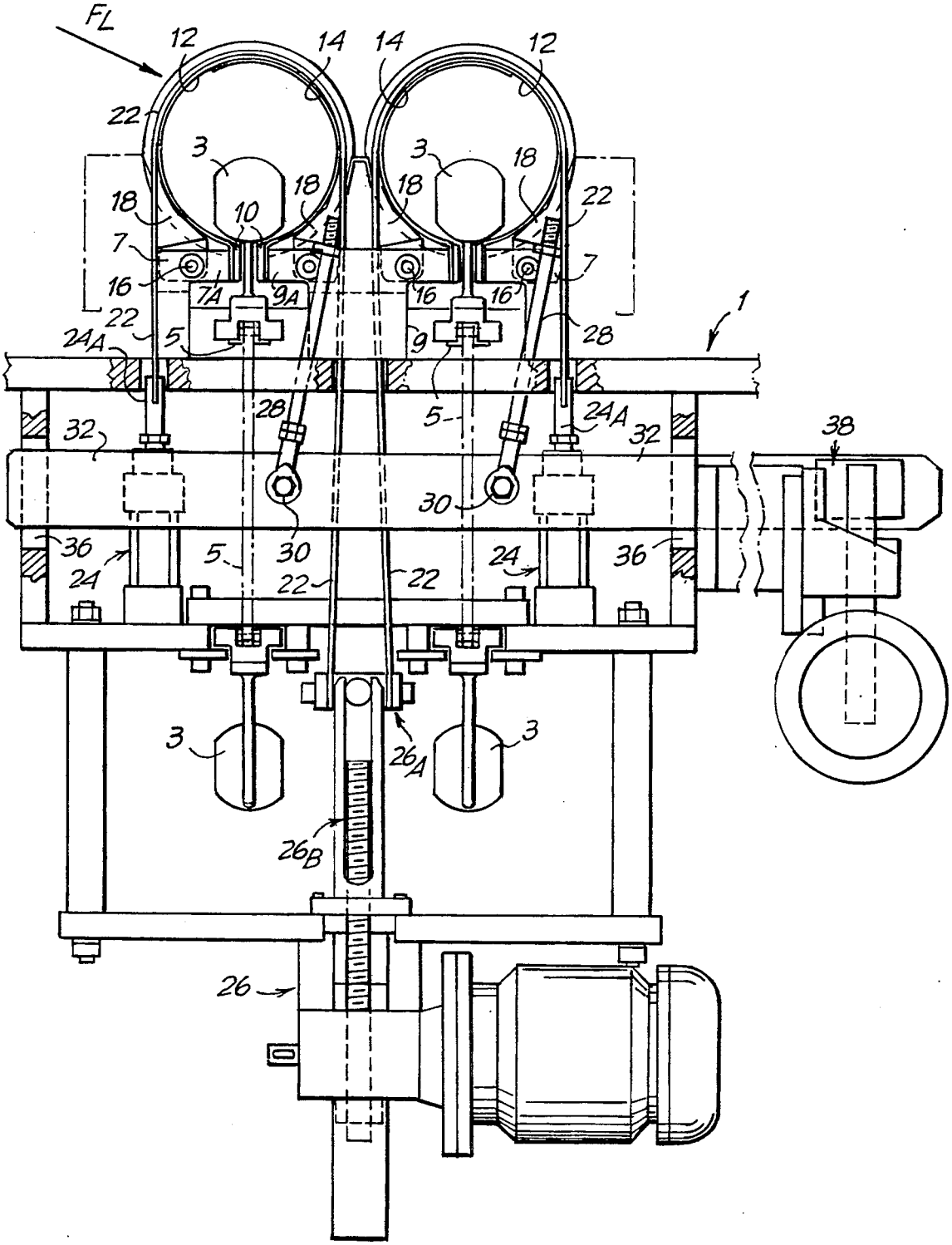
Figure 2:
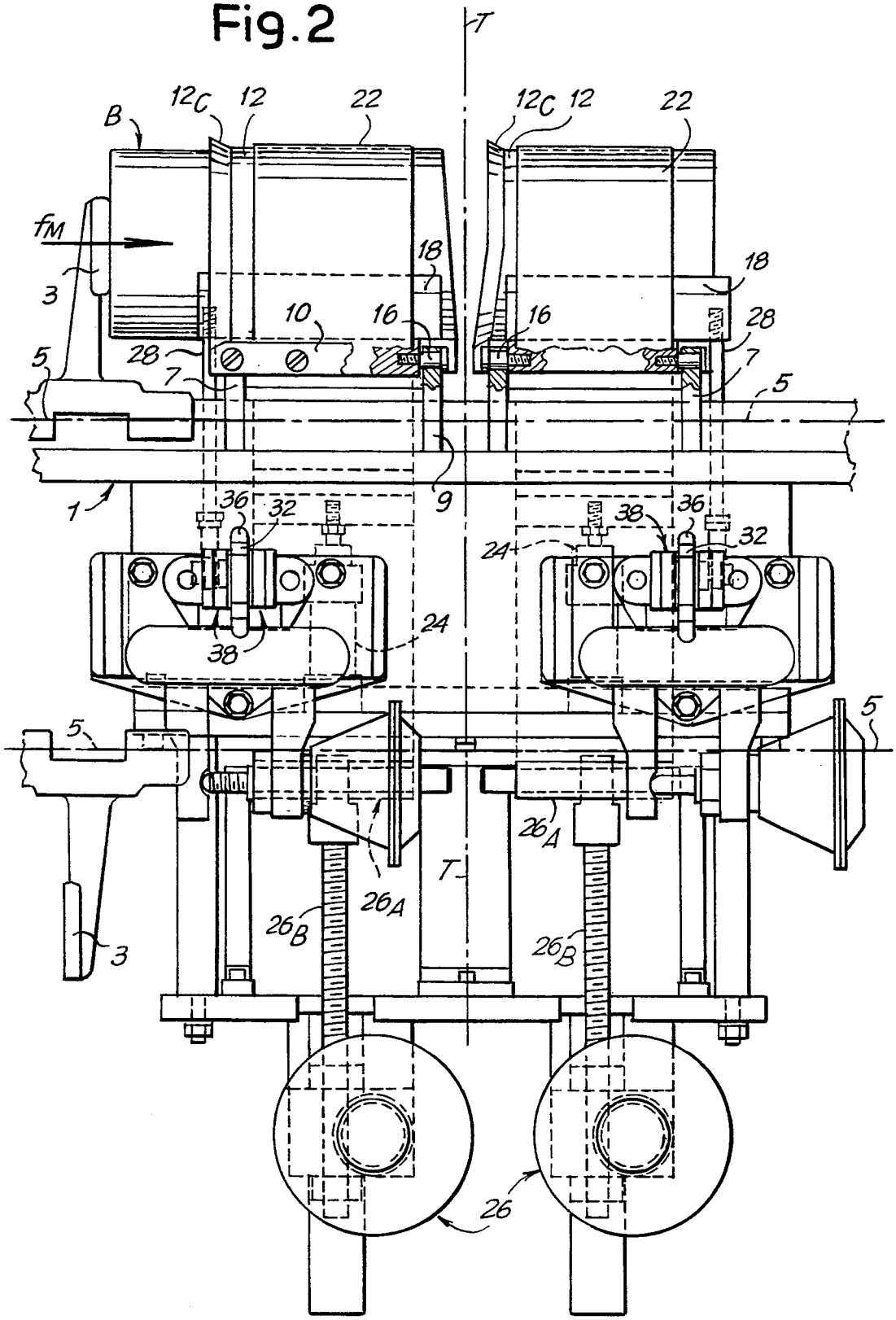
Figure 3:
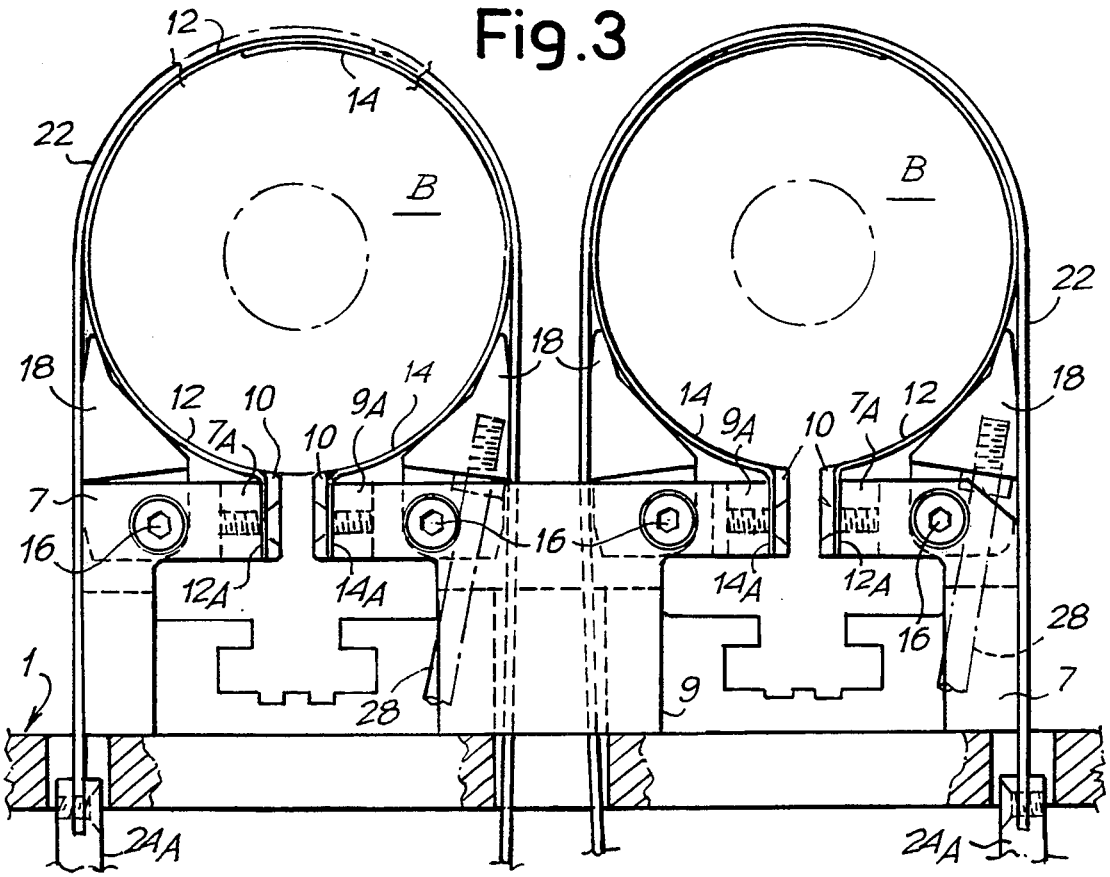
FIGS. 3, 4 and 5 show enlarged details, in three different geometries, of the working elements of the clamp for adaptation to three different diameters of the material.
Figure 4:
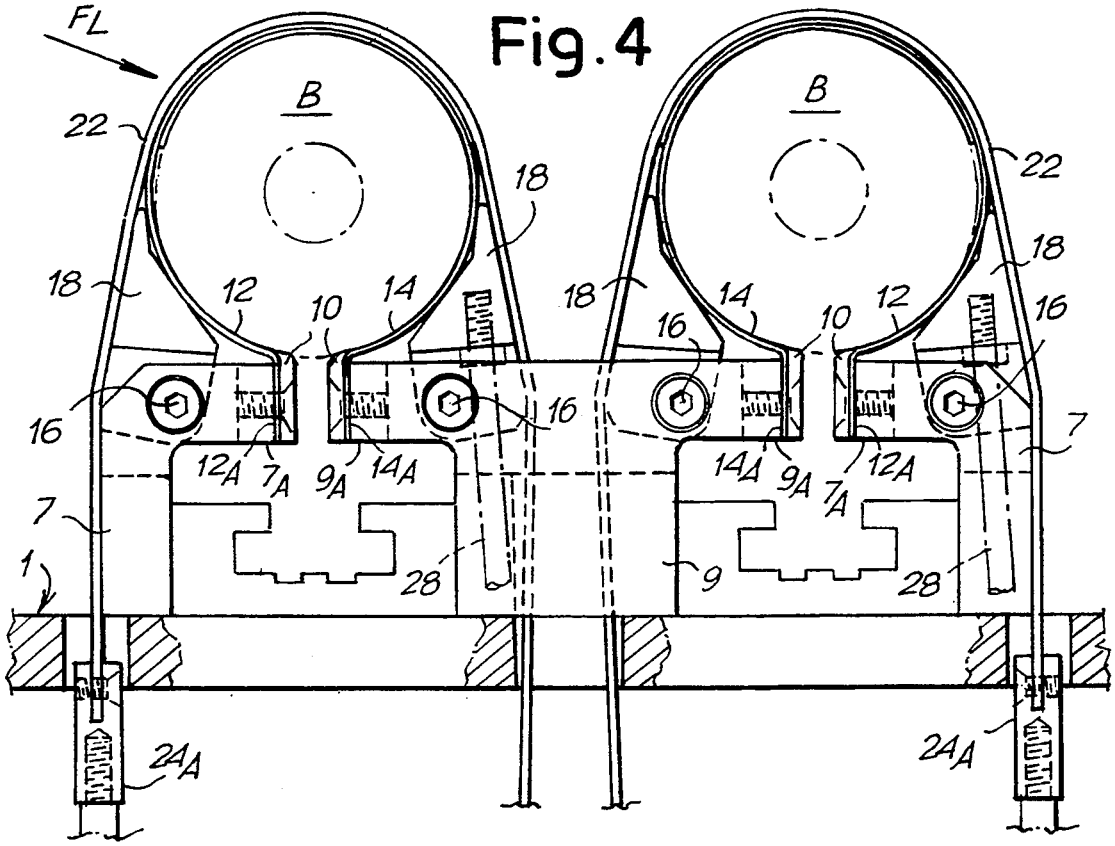
Figure 5:
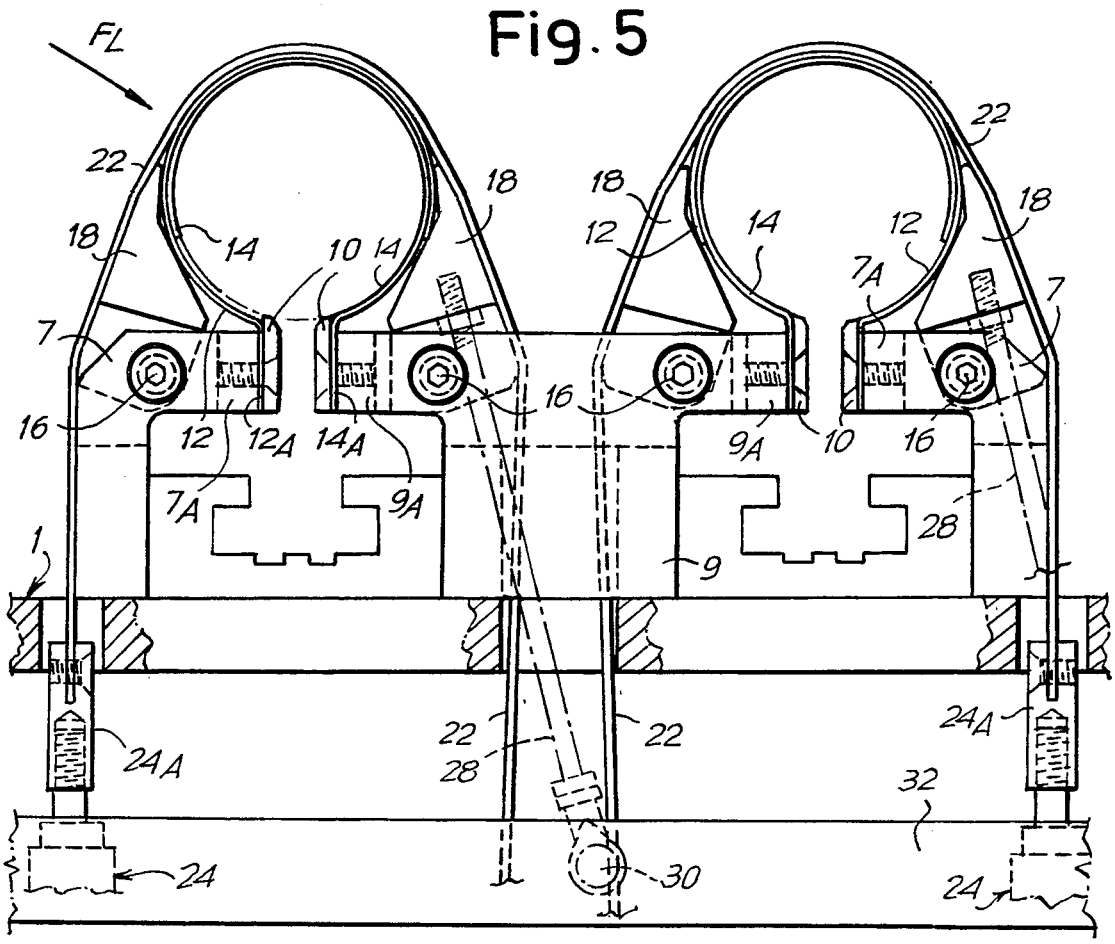
Figure 6:
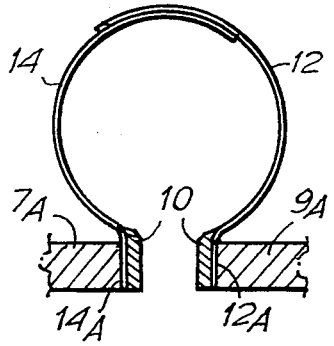
FIG. 6 shows a pair of strips in isolation for greater clarity.

According to the illustrations in the attached drawing (with reference initially to FIGS. 1 to 7), 1 indicates a support structure of the clamp device, which is developed in the cutting plane and whose path is indicated by T in FIG. 2. On either side of this path are the clamps which act on the cylindrical material advanced in the direction of the arrow FM under the action of pushing extensions 3 which are carried by schematically indicated chain conveyers 5; these conveyers 5 have a continuous chain and act on the ends of the rolls or logs indicated overall by B, one end of which, shown in FIG. 2, is pushed by one of the extensions of the pushers 3. In the cutting plane with the path T—T, a circular blade rotating about its own axis and movable about another axis (which may be nearer or farther away) causes the rolls or logs to be cut into a number of small rolls which are then sent for packaging for distribution. Next to the cutting plane with the path T—T, the material being processed must be pressed by elements which bind it and keep it compressed and positioned with respect to the pushers to ensure the precision of the spacing between the cuts, in such a way as to ensure uniformity of cutting in said material. These pressing elements (clamps) must be able to be adapted easily to the different diameters of the material in rolls or logs B which are processed from time to time. FIGS. 3, 4 and 5 indicate three different diameters of the rolls or logs. The advancing material, which is guided in suitable sliding cradles, must therefore pass through these elements of the retaining and pressing device, or clamps as they are called, both before reaching the cutting plane and after the cutting plane with respect to the direction of the arrow FM. Normally, the cutters have at least two sliding cradles to process simultaneously and with the same cutting blade two rows of rolls advancing in the corresponding cradles and with corresponding pushers 3 and 5, as shown in the drawing. In a solution of this kind, four clamps, in other words four pressure retaining devices, are obviously provided, one pair acting on the same piece of material being processed, one before and one after the cutting plane with the path T—T in FIG. 2.

The clamps concerned will now be described.

7 indicates pairs of external supports and 9 indicates intermediate supports, which have, next to the vertical longitudinal plane of symmetry of each sliding area of a roll or log, surfaces 7A and 9A respectively which, with the aid of plates 10, form corresponding enclosing holders for the ends 12A, 14A of pairs of flexible strips 12 and 14 which also have an elastic tendency to expand and are shaped in a substantially symmetrical way to form in combination a housing through which the advancing roll or log B passes, the pressure on the material to be cut being exerted by said strips. The holders formed by the components 7, 10 and 9, 10 are spaced a short distance apart to permit the passage of the extensions 3 of the pushers engaged in the chain 5.

The opposing supports 7 and 9 are pivoted at 16 on shaped blocks 18 which form oscillating cradles capable of forming a support for the strips 12 and 14 in the extension of the lower part of the slide path which said strips 12 and 14 form for the sliding of the material. The oscillating cradles 18 may have different angular geometries according to the diameter of the material being processed, as may be seen by comparing FIGS. 3, 4 and 5, which show the geometry for the largest, medium and smallest diametric section of the advancing material; the oscillating cradles 18 are capable of assuming symmetrical positions with respect to the longitudinal and vertical plane of symmetry of the advancing material, under the action of the means described below which act on the pairs of strips 12, 14.

The angular position which is spontaneously assumed and is symmetrical for the two oscillating cradles interacting with the same pair of strips 12 and 14 is fixed in the way described below.

To adjust and modify the geometry of the pairs of strips 12 and 14 of each clamp, and to exert the force, in other words the pressure, radially on the material being processed, it is provided that the upper part of the strips 12 and 14, which are more or less partially overlapped, is surrounded by a strap 22. This strap is fixed at one end to a holder 24A on a pneumatic spring 24 (collectively called an elastic holder) which acts on the outer part of the pair of adjacent damp straps 22, as seen in FIG. 1 in particular; this holder thus ensures that the strap can yield in the case of dimensional anomalies of the material. The inner parts of the two straps 22 are fixed to a double holder 26A of a jack 26 (collectively called an adjusting holder), which may normally be a mechanical jack capable of sliding vertically in such a way as to vary in the upper curve the geometry of the two straps 22 surrounding the pairs of strips 12, 14 of the two clamps. When, as shown in FIG. 2, clamps contiguous on either side to the cutting plane are provided at the positions of each of the two slide paths for two rolls processed simultaneously, two adjacent mechanical jacks 26 may be provided as shown in FIG. 2, or a single mechanical jack 26 may be provided in which case there are four holders 26A (instead of two) for the four straps 22 surrounding the four pairs of strips 12, 14. The straps 22 skim the blocks forming the shaped cradles 18 oscillating about the axes defined by the pins 16. By varying the position of the holders 26A of the jack or jacks 26, a greater or lesser elastic expansion of the strips 12 and 14 may be obtained; in other words, a greater or lesser overlap of the free ends of said strips 12, 14 may be provided in the upper area of the space delimited by said pairs of strips 12 and 14. The above may easily be deduced from a comparison between FIGS. 3, 4 and 5, which show three of a multiplicity of geometries which are also continuously adjustable. By operating the jack or jacks 26, and by suitable adjustments which may be provided for the exact adaptation of the end holders of the straps, it is possible to provide one or other of the geometries capable of being assumed by the pairs of strips 12 and 14, to adapt them to the diameters of the materials being processed and to the amount of pressure with which said strips are to act on the material radially and centripetally. The geometry is set by the holders 26, and the elastic pressure is set by the pneumatic springs 24 of the piston and cylinder or equivalent type, whose operation may easily be adjusted and modified in a substantially uniform manner by controlling the supply pressure of the pneumatic springs 24 of the assembly.

The oscillating cradles 18 may be locked in the position which they have reached for the adaptation to the diameters of the material being processed. For this purpose it may be provided that at least one of the two cradles 18—that subject to the force of the blade in the direction FL—of each pair interacting with a pair of strips 12, 14 is fitted with an extension 28 embedded in the block of the cradle and pivoted at its end at 30 on a plate 32, which may be displaced in a vertical plane orthogonal to the axes of the advancing materials and which moves in apertures 36 of the frame 1. As a result of the orientation of the cradles 18 and consequently of the extensions 28, the plate 32 assumes different positions according to the angular geometry assumed by said cradles. After this geometry of the cradles 18 about the pivots 16 has been reached, and consequently after the corresponding position has been reached by the plate 32, the latter is locked with tension jaw means 38 which fix the position of the plate 32 and consequently the position of the cradles 18.

The strips 12 and 14 may be made of suitable elastic materials, in particular steel or polycarbonate or similar materials. The edge facing the material entering in the direction of the arrow FM is flared as shown at 12C in FIG. 2, as far as the strip 12 of the pair of strips 12 and 14 is concerned.

Figure 7:
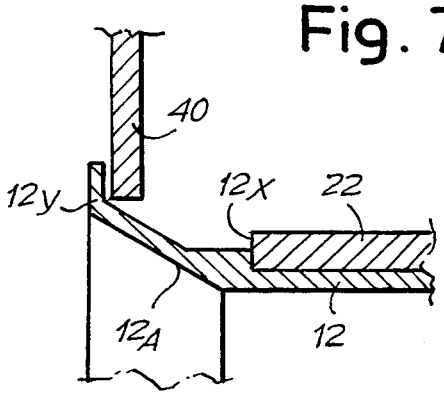
FIG. 7 shows a device which prevents the strips from being dragged by the log during the feed movement.

The inner surface of the strips 12 and 14 may be sufficiently ground or in any case treated so as to have minimum friction with the material advancing in the direction of the arrow FM, as a result of which the strips 12 and 14 may be only minimally subject to a dragging effect in the direction of the arrow FM by the material advancing for processing. Moreover, the possibility of providing suitable means, particularly dogs, which act on the strips 12 and 14 to prevent them from being dragged and consequently bent in the direction of advance of the material shown by the arrow FM, is not excluded. One of the solutions—which is visible in detail in FIG. 7—may provide for the formation of a dog, in other words a stop 12X on the strips such as 12, to interact with the corresponding edges of the strap 22, this being particularly secure for the size and for the type of fixing of said strap. Another arrangement, as indicated in FIG. 7, is to form a stop, in other words a dog, as indicated by 40, to act on an edge or abutment 12Y of the flared profile 12A of the strips such as 12 and 14, or also to act on the opposite edge of the strips 12 and 14, particularly in the area of overlap of said strips, in other words in the area of the upper curve of the sliding space of the material in roll or log form; the dogs, in other words stops, such as 40 or that which may act on the opposite edges of the strips, will be adjustable according to the geometry assumed by the strips so that they can be adapted to the diameter of the material. The dog formed by the stop 12X acting on the strap 22 as shown in FIG. 7 is clearly adapted automatically by the movement and mutual guiding of the strips and of the strap.

With the arrangement described it is possible to modify the geometry of the clamps rapidly, to adapt this geometry to the dimensions of the material processed at any time, while maintaining the correct operation of the clamps with uniform distribution of the pressure over the whole periphery of the material being processed, and with the possibility of even very fine adjustments of the elastic pressure action of the different clamps through the adaptations of the pneumatic springs and the adjustments of the holders or the fixing elements of the holders by the return effect provided by the jacks such as 26 or also by the holders such as 24A of the pneumatic springs 24.

Figure 8:
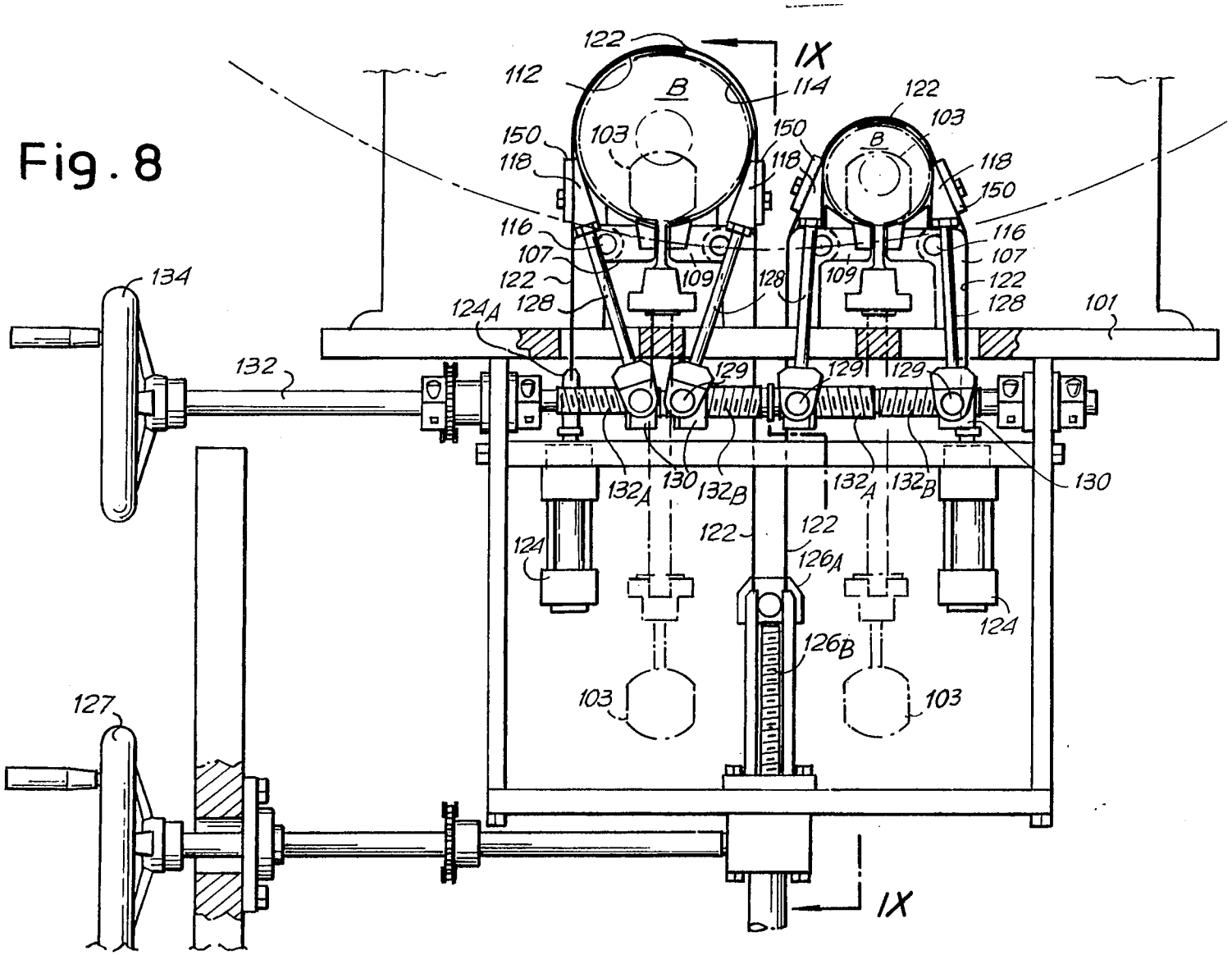
FIG. 8 shows a front view of the device according to the invention, in a modified embodiment.
Figure 9:
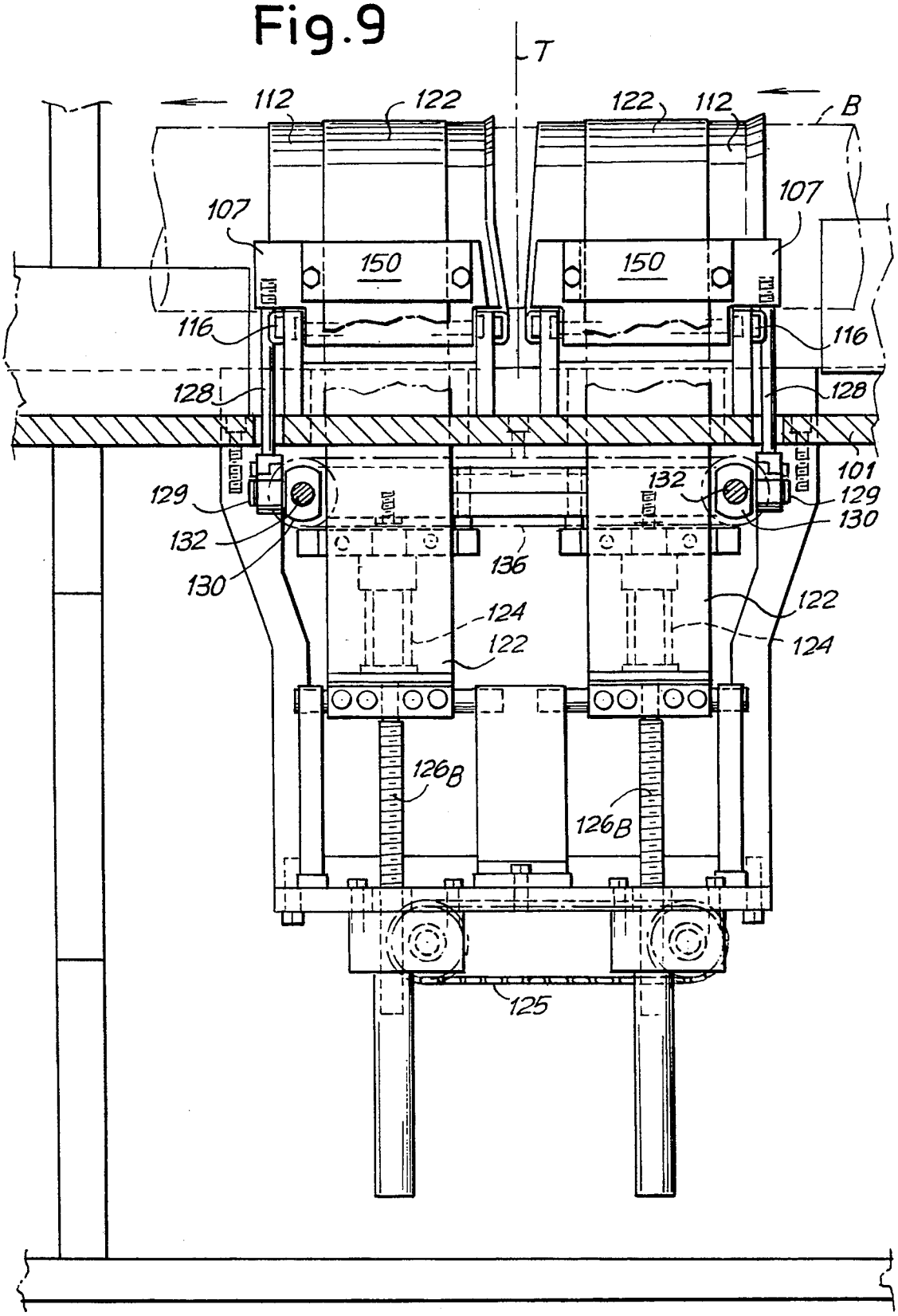
FIG. 9 shows a view along IX—IX in FIG. 8.

FIGS. 8 and 9 show, in a front and side view, a somewhat modified embodiment of the device according to the invention. 101 again indicates the supporting structure of the clamp device, and T in FIG. 9 indicates the path of the cutting plane. 103 indicates the pushing extensions or pushers for advancing the logs. 107 and 109 indicate outer and intermediate supports respectively, corresponding to the supports 7 and 9 of the example of embodiment illustrated in FIGS. 1 to 6. Flexible strips 112 and 114, corresponding to the strips 12 and 14 in the preceding example, are fixed to the supports 107 and 109 respectively.

Shaped blocks 118, corresponding to the blocks 18, are pivoted at 116 on the supports 107 and 109, and form oscillating cradles capable of providing a support for the strips 114 and 112 in their lower part. As described above with reference to the oscillating cradles 18, the oscillating cradles 118 may also assume various angular geometries according to the diameters of the logs to be cut, by rotating about the pivot axis 116.

A corresponding strap 122 passes over each pair of strips 112, 114. Each strap 122 is fixed at one of its ends to a holder 124A of a cylinder and piston actuator 124 which acts as a pneumatic spring. The opposite end of each strap 122 is coupled to a double holder 126A coupled to a threaded rod 126B capable of being raised and lowered by means of a handwheel drive 127 or by an electric drive. As seen in particular in the side view in FIG. 9, a single handwheel 127 operates two threaded bars 126B, between which is provided a chain transmission 125.

The function of the straps 122, of the pneumatic springs 124 and of the fixing system 126 corresponds to that of the similar elements illustrated in the example shown in FIGS. 1 to 6 and is therefore not described in greater detail.

Each block or oscillating cradle 118 is integral with an extension or rod 128 whose lower end is pivoted at 129 on a threaded bush 130 interacting with a threaded bar 132. As shown in particular in FIG. 8, the threaded bushes 130 of the rods 118 associated with the two oscillating cradles 118 of each sliding path of the log are threaded onto two adjacent sections 132A and 132B of the same threaded bar 132. The two sections 132A and 132B differ in the direction of the threading, so that a rotation in one direction of the threaded bar 132 causes symmetrical movements in opposite directions of the threaded bushes 130 associated with the rods 128 of two oscillating cradles 118 of the same sliding path of the log.

A single handwheel 134 may be used to rotate, through a chain transmission 136, two parallel threaded bars 132 to simultaneously cause the sliding of all the bushes 130 and consequently the simultaneous oscillation of all the oscillating cradles 118 associated with the eight elastic strips 112 and 114 provided in the device shown in FIGS. 8 and 9.

FIG. 8 shows the two end positions which the oscillating cradles 118 may have: in the left-hand sliding lane in the figure, the oscillating cradles 118 are in their maximum opening position, corresponding to the maximum log diameter which can be processed with the device. In the right-hand sliding lane in FIG. 8, the oscillating cradles 118 are shown in their position corresponding to the minimum log diameter which can be processed.

With the arrangement described here it is possible to simultaneously adjust the position of the oscillating cradles 118 with respect to the two strips 112, 114 and that of each pressure group and to lock both said cradles.

A special arrangement (which may also be adopted in the embodiment in the preceding figures) to enable each strap 122 to be guided correctly is shown in the embodiment in FIGS. 8 and 9. For this purpose, a plate 150 is fixed to each block or oscillating cradle 118. The plate 150 forms, together with the surface of the associated block 118 to which it is attached, a slide and guide path for the corresponding strap 122. In this way the strap 122 always takes up a correct position even in the processing of the minimum diameter (see the right-hand side of FIG. 8).

Figure 10:
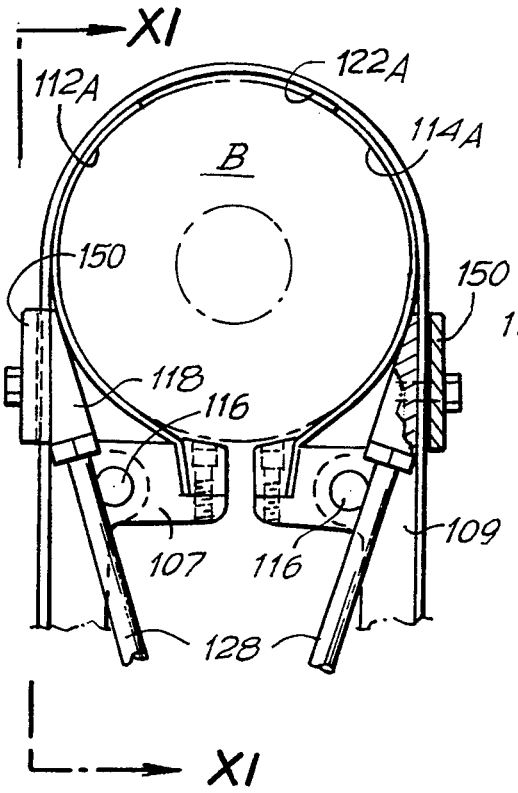
FIG. 10 shows a front view of a detail of a variant embodiment.
Figure 11:
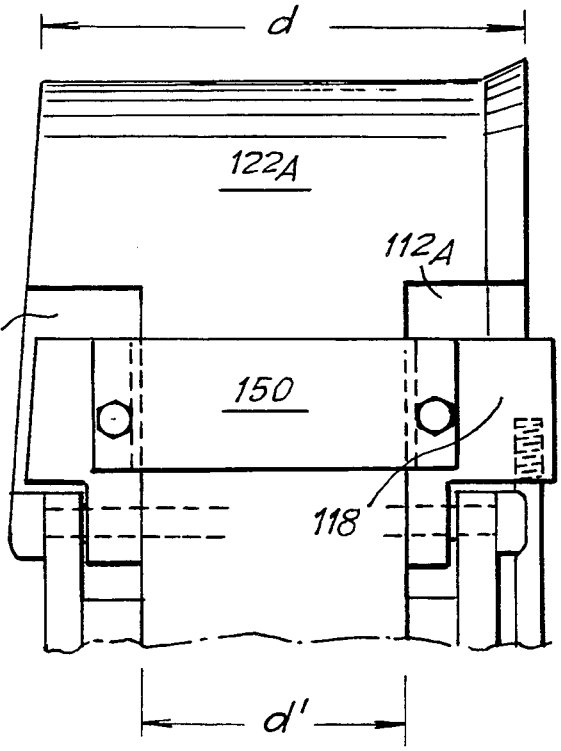
FIG. 11 shows a side view along XI—XI in FIG. 10.

In the embodiments described up to this point, the strips 12, 14 and 112, 114 extend for a length such that their ends overlap above the log. The amount of overlap is a function of the diameter of the log being processed. However, the possibility of operating with shorter strips, which therefore do not overlap each other (at least for certain diameters of the log) is not excluded. This case is shown schematically in FIGS. 10 and 11, where the strips are indicated by 112A and 114A. As seen in particular in FIG. 10, the extension of said strips is such as to leave free a portion of the cylindrical surface of the log passing through. This upper area of the log is clasped by the strap 122A. To ensure a proper grip, in this case the strap 122A may have an intermediate portion of width equal to the longitudinal extension of the strips 112A and 114A, in other words a width equal to the dimension d indicated in FIG. 11, with a flared profile 122C. This portion of the strap 122A is located in the upper clasping area of the log. The parts of the strap 122A extending downward have a smaller width d', equal for example to that of the strap 122 in FIGS. 8 and 9. This configuration of the elastic strips 112 and 114 and of the strap 122 may also be adopted in the embodiment in FIGS. 1 to 6.

It is to be understood that the drawing shows only an example provided solely as a practical demonstration of the invention, it being possible to vary this invention in its forms and arrangements without thereby departing from the scope of the guiding concept of said invention.

Any presence of reference numbers in the attached claims has the object of facilitating the reading of the claims with reference to the description and to the drawing, and does not restrict the scope of protection represented by the claims.

I claim:

1. A log-clamping device for a log-cutting machine capable of cutting one or more logs, including for each log an advancing path with a log-cutting device operating in a log-cutting plane at right angle to the advancing path, and on each side of each log-cutting plane:

a pair of enclosing supports;

a pair of symmetrically curved, elastically flexible strips, each having an inner surface and an outer surface;

a first end of each strip being supported by a respective one of said pair of enclosing supports with a portion of said strip extending from said support to form, with its inner surface, a sliding seat for the log, the portion of said strip extending from said support capable to spread apart elastically;

an elastic holder;

an adjusting holder;

a strap having a first end which is anchored to said elastic holder and a second end anchored to a mobile adjusting holder with said strap surrounding said pair of flexible strips, said adjusting holder adjusting a variation of the geometry of said flexible strips in relation to a variation in the diameter of the log to be processed; and two opposing oscillating cradles arranged adjacent to said enclosing support, said cradles being in contact with the outer surface of each said flexible strip.

2. The device of claim 1 wherein at least one of said two oscillating cradles is combined with locking means which lock the cradle in an angular position assumed as a result of the adjustment of said flexible strips to the diameter of the log being processed.

3. The device as claimed in claim 1 wherein said elastic holder is pre-stressed.

4. The device as claimed in claim 1 including a control element combined to said adjusting holder to adjust said straps.

5. The device as claimed in claim 4 including two pairs of said strips and two of said straps arranged in side-by-side relationship for simultaneous retention of two parallel logs, and a single said control element acting on the two side-by-side arranged straps.

6. The device as claimed in claim 4 including a single said control element which acts on two of said straps, one on the upstream side and one on the downstream side of the log-cutting plane.

7. The device as claimed in claim 1, 2, 3 or 4 including stops which act on abutments of said strips to prevent dragging the strips due to friction with the log during the log's advance.

8. The device as claimed in claim 1, 2, 3 or 4, including stops which act on abutments of said strips to prevent dragging the strips due to friction with the log during the log's advance, said stops being formed by edges of said straps.

9. The device as claimed in claim 1, 2, 3 or 4 wherein said strips have a length such that their free ends partially overlap each other, the amount of overlap varying with the diameter of the log to be cut.

10. The device as claimed in claim 1, 2, 3 or 4 wherein said strips have a length such that they do not completely envelope the log in its upper part, and wherein said strip has, at least where the material is clasped, a portion whose width corresponds approximately to the width of said strips and is provided.

11. The device as claimed in claim 1 wherein at least one of said oscillating cradles includes a rod connecting said one cradle to a plate by means of a corresponding joint, said plate being movable in a plane orthogonal to the axes of oscillation of the cradles, and a brake shoe being provided for locking the plate and the cradle connected thereto in an angular operating position.

12. The device as claimed in claim 1 wherein each of said two cradles associated with each pair of said flexible strips is coupled to a first end of an extension, the opposite end of each extension being pivoted on a threaded bushing interacting with a threaded bar extending substantially at a right angle with respect to the oscillation axes of the cradles, the rotation of said threaded bar causing the adjustment of the angular position of said cradles.

13. The device as claimed in claim 12 wherein said threaded bar has two portions with opposing threads onto which are threaded the bushings associated with the two oscillating cradles with respect to a pair of said strips, the rotation of said bar causing the simultaneous adjustment of the positions of both oscillating cradles.

14. The device as claimed in claim 1, 11, 12 or 13 wherein each said oscillating cradle is associated with means for guiding said strap.

* * * * *